United States Patent [19]

Maier

[11] Patent Number: 4,951,334

[45] Date of Patent: Aug. 28, 1990

[54] PRESSURE RELIEF CUSHION

[76] Inventor: Edmund K. Maier, 76 Woodside Dr., Penfield, N.Y. 14526

[21] Appl. No.: 385,567

[22] Filed: Jul. 26, 1989

[51] Int. Cl.[5] ..... A47C 27/00

[52] U.S. Cl. ..... 5/431; 5/436; 5/468; 5/481; 297/459

[58] Field of Search ..... 5/431, 436, 461, 468, 5/481; 297/458, 459, DIG. 1

[56] References Cited

U.S. PATENT DOCUMENTS

| | | | |
|---|---|---|---|
| 2,085,296 | 6/1937 | Carey | 5/481 |
| 2,257,848 | 10/1941 | Larkin | 5/448 X |
| 3,833,259 | 9/1974 | Pershing | 5/481 X |
| 3,987,507 | 10/1976 | Hall | 5/436 X |
| 4,122,567 | 10/1978 | Hanson | 5/448 X |
| 4,682,818 | 7/1979 | Morell | 5/464 X |
| 4,688,285 | 8/1987 | Roberts | 5/468 |
| 4,819,288 | 4/1989 | Lowthian | 297/458 X |
| 4,824,174 | 4/1989 | Dunn, Sr. | 297/458 X |

FOREIGN PATENT DOCUMENTS

| | | | |
|---|---|---|---|
| 8607528 | 12/1980 | PCT Int'l Appl. | 297/DIG. 1 |
| 2016918 | 9/1979 | United Kingdom | 5/464 |

OTHER PUBLICATIONS

Literature on the "Profile Seating Orthosis" Published 1983, 1985 by AliMed Inc., Boston, MA 02111.

Literature on the "Tush Cush" Orthopedic Cushion published 1986, by KDI Inc., San Diego, CA 92131.

*Primary Examiner*—Michael F. Trettel

*Attorney, Agent, or Firm*—Howard J. Greenwald

[57] ABSTRACT

A pressure relief cushion with a gross effective spring rate of from about 75 to about 300 pounds per inch is disclosed. This cushion contains at least two different resilient materials, each of which has a different identation force deflection rating; and it also has a substantially U-shaped aperture in its back side.

6 Claims, 3 Drawing Sheets

34
36
20
16
48

78
24
60
16
78
3
20
3
68
66
62
70
78

16
18
20
22
64

52
48
50
46
56
58
42
44

PRESSURE RELIEF CUSHION

FIELD OF THE INVENTION

A cushion for eliminating pressure on portions of the human body.

BACKGROUND OF THE PRIOR ART

Patients who are forced to sit for prolonged periods of time often experience decubitis ulcer (pressure or bed sore) problems due to the length of time they are forced to sit. The concentrated pressure upon the patients' Ischia (bony, downward projections from the pelvic girdle) caused by prolonged sitting often leads to ulceration of the tissue between the seating surface and the bony, Ischial protrusions.

U.S. Pat. No. 4,688,285 of Robert discloses a medical cushion for minimizing pressure areas on portions of the human anatomy. This cushion contains an aperture extending completely through the cushion from its top to its bottom. However, the cushion of this patent does not substantially eliminate pressure upon the Ischia of a patient; and, because of the location of its aperture, it is relatively difficult to use. Furthermore, because the cushion consists essentially of only one foam material, it does not provide the proper blend of resilience and support required for long term use by patients.

U.S. Pat. No. 2,257,848 of Larkin discloses a hip rest for patients comprised of a rigid material, such as wood. Although the hip rest of Larkin provides sufficient support, it is too rigid and uncomfortable to use, especially for relatively active patients who are subjected to jarring loads.

U.S. Pat. No. 4,122,567 of Hanson discloses an articulated bed having a U-shaped cavity along one of its ends. The function of the Hanson device is to facilitate sexual intercourse between two people supported upon the bed. There is no disclosure in Hanson of means for minimizing pressure upon the Ischials of a person sitting on the mattress, and the mattress of Hanson does not appear to have the combination of resilience and support required for a pressure relief cushion.

U.S. Pat. No. 2,085,296 of Carey describes an invalid cushion with two cloth sheets that are stitched together to provide a pocket for padding. The cushion of this patent does not appear to provide the proper blend of resiliency and support; furthermore, the aperture in this patent is located such that it is relatively inconvenient for a patient to use.

U.S. Pat. No. 3,833,259 describes a vehicle seat containing three layers of polymer foams. However, the cushion of this patent does not provide any means for eliminating pressure upon the Ischial area.

It is an object of this invention to provide a cushion which will tend to substantially eliminate pressure upon a patient's Ischial area when he sits upon it.

It is another object of this invention to provide a cushion which will provide a unique combination of resiliency and support.

It is another object of this invention to provide a lightweight cushion which can be readily handled by invalids.

SUMMARY OF THE INVENTION

In accordance with this invention, there is provided a cushion which contains at least three layers of resilient material, at least two of which have different stiffnesses. The cushion has a gross load deflection rate of from about 150 to about 275 pounds per inch. The top layer and the bottom layer of the cushion has a indentation load (or force) deflection ("ILD") of from about 50 to about 80 pounds. The intermediate layer of the cushion has an ILD of from about 100 to about 130 pounds.

DESCRIPTION OF THE DRAWINGS

The present invention will be more fully understood by reference to the following detailed description thereof, when read in conjunction with the attached drawings, wherein like reference numeral refer to like elements and wherein.

DESCRIPTION OF THE PREFERRED EMBODIMENT

Figure 1:
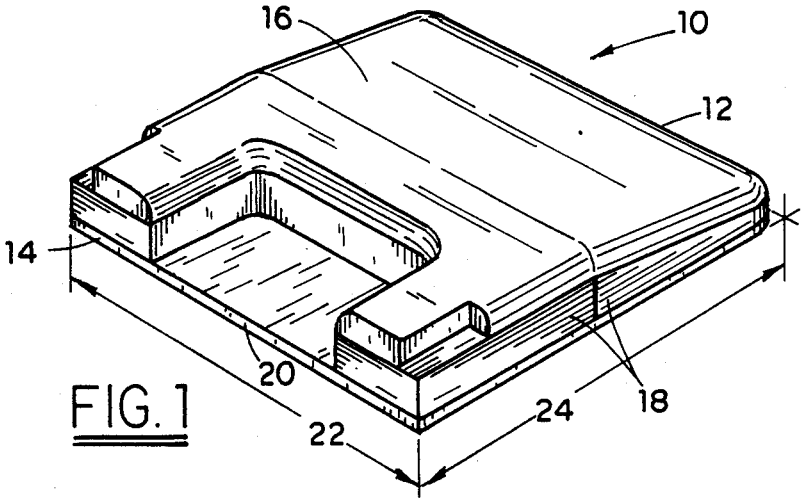
FIG. 1 is a perspective view of one preferred embodiment of the invention.

The Figures illustrate a preferred embodiment of the invention. Referring to FIG. 1, pressure relief cushion 10 is shown. Cushion 10 is comprised of front portion 12, rear portion 14, upper layer 16, intermediate layer 18, and bottom layer 20. The materials, and the manner in which they are configured in the cushion, provide a device with a unique combination of properties.

Cushion 10 is preferably comprised of at least two foam materials, each of which has different physical properties. The term foam, as used in this specification, refers to a material with a spongelike, cellular structure and includes materials such as polyurethane foam, foam rubber, flexible foamed thermoplastic elastomers, and the like. Reference may be had, e.g., to George S. Brady et al.'s "Materials Handbook," Twelfth Edition (McGraw-Hill Book Company, New York, 1986), the disclosure of which is hereby incorporated by reference into this specification.

In one preferred embodiment, at least two of layers 16, 18, and 20 consist essentially of different types of foam such as, e.g., polyurethane foam. As is known to those skilled in the art, urethanes are a group of plastic materials based on polyether or polyester resin; see, e.g., pages 848–849 of said Brady et al. book. Also see pages 325–335 of Brage Golding's "Polymers and Resins" (D. Van Nostrand Company, Inc., Princeton, N.J., 1959), the disclosure of which is also incorporated by reference into this specification.

One preferred class of urethane foam is urethane elastomers made with various isocyanates such as, e.g., toluene diisocyanate ("TDI") and/or 4,4'-diphenylmethane diisocyanate ("MDI") reacting with linear polyols of the polyester and polyether families. Thus, by way of illustration and not limitation, one may use a polyurethane foam obtainable from the Recticel Foam Corporation of Leroy, N.Y. and identified as product number GP220125N as intermediate layer 18; this foam has a density of about 2.15 pounds per square foot, from about 60 to about 70 cells per inch (CPI), and an indention load deflection ("ILD") of at least about 125 pounds. Thus, one may use a polyurethane foam for upper layer 16 and/or bottom layer 20 selected from the group consisting of Recticel foams GC170070N, GY170070C, and mixtures thereof; these foams are substantially identical to each other with the exception that the latter one is flame-retardent and the former one is not; and each of them have a density of at least 1.7 pounds per cubic foot, from about 60 to about 70 cells per inch, and an ILD of at least about 70 pounds.

In the embodiment in which at least two different polyurethane foams are used in the cushion, the foam used in the top layer 16 and/or the bottom layer 20 of the cushion will preferably have a density of from about 1.5 to about 5.0 pounds per cubic foot and, preferably, from about 1.7 to about 2.25 pounds per cubic foot. The tensile strength of the foam in layers 16 and/or so is at least about 1.25 pounds per square inch (p.s.i.) and, preferably is at least about 1.75 p.s.i. The tear resistance of the foam in layers 16 and/or 20 is at least about 1.5 pounds per square inch and, preferably at least about 1.8 p.s.i. The Compression Set of the foam in layers 16 and/or 20 is no greater than about 8 percent and, preferably no greater than about 5.5 percent. The load (force) deflection (ILD) of the foam in these layers is from about 50 to about 90 pounds and, preferably, from about 65 to about 85 pounds. Each of these properties is determined in accordance with A.S.T.M. Standard Test D-3574-81, the disclosure of which is hereby incorporated by reference into this specification.

In the aforementioned embodiment, in which the cushion 10 is comprised of at least two different layers of polyurethane, the stiffer part of the intermediate layer will have most of its properties fall within the ranges specified for the properties of the foam of layers 16 and 20. Thus, e.g., the density, the tensile strength, the tear resistance, the elongation, and the compression set of the foam of such part will be within the ranges specified for these properties for the foams of layers 16 and 20. It is to be understood that, although the properties fall within the same ranges, they need not be identical. However, the load (force) deflection (ILD) of the foam of the stiffer part 34 of intermediate layer 18 will be from about 100 to about 150 pounds and, preferably, from about 115 to about 130 pounds.

In one embodiment, each of upper layers 16 and bottom layers 20 consist essentially of polyurethane foam, which may be the same material or different, and intermediate layer 18 consists essentially of a different foam material such as, e.g., neoprene foam, foamed thermoplastic material, and the like.

In one preferred embodiment, one or more of layers 16, 18, and 20 consists essentially of synthetic rubber foam which is described, e.g., on pages 276–282 of said "Materials Handbook." Thus, by way of illustration, one may use styrene-butadiene elastomers such as Buna S, SBR, GR-S, and the like. One may also use neoprene (also known as chloroprene). One may use butyl rubbers (isobutylene-isoprene elastomers), isoprene, polyacrylate elastomers, nitrile elastomers ("NBR" rubbers), polybutadiene elastomers), and the like. The precise chemical identity of the layers involved in applicant's cushion is not critical; what is, important is the physical properties obtainable with the proper combination of components.

In one preferred embodiment, in which layers 16, 18, and 20 each consist essentially of polyurethane material, cushion 10 weights from about 0.75 to about 2.0 pounds.

In one embodiment, the width 22 of cushion 10 is substantially equal to the length 24. In another embodiment, not shown, width 22 is less than length 24. In yet another embodiment, width 22 is greater than length 24.

Each of width 22 and length 24 preferably will be from about 13 to about 24 inches. By way of illustration and not limitation, one may use a cushion with a width and length of 13 inches, or 14 inches, or 15 inches, or 16 inches, or 17 inches, or 18 inches. Thus, one may use a cushion with dimensions of 13"×15", 14"×15", 15"×16", 15"×17", 15"×18", 16"×17", 16"×18", 16"×19", 17"×18", 17"×18", 17"×19", 17"×20", 17"×21", and the like.

The cushion 10 of this invention has an effective gross spring rate of from about 75 to about 300 pounds per inch. It is preferred that the cushion have an effective gross spring rate of from about 130 to about 273 pounds per inch. As used in this specification, the term effective gross spring rate refers to the spring rate measured in accordance with the spring rate test.

In the spring rate test, a wooden board which is 0.5 inches thick, 18.75 inches long, and 12.25 inches wide is placed on the rearward half of upper layer 16 of the cushion so that it covers the U-shaped portion 26 of cushion 10. Said U-shaped portion 26 is comprised of left arm 28, right arm 30, and front portion 32. The wooden board covers substantially all of the U-shaped portion, including said right arm, said left arm, and said front portion thereof.

Once the wooden board has been placed upon upper layer 16 of the cushion, a force of 150 pounds is applied at the center of the board in a downward direction. Thereafter, the amount of distance cushion 10 is compressed is measured by noting the difference between the height of the cushion prior to compression and thereafter; the measurement is taken only after the compressive load has been applied to the cushion 10 for at least 5 minutes. The difference in the "time zero" height and the 5 minute height of the cushion, in inches, is recorded.

The effective gross spring rate is equal to the force (150 pounds) divided by the compression distance; it is recorded in pounds per inch.

In order to produce a cushion 10 with the desired effective gross spring rate, one should use materials in layers 16, 18, and 20 which exhibit certain specified properties. In particular, the effective ILD of intermediate layer 18 should be at least 150 percent greater than the ILD of either layer 16 or layer 20.

Layer 18 may consist essentially of only one foam material. In the ILD test, a sample of the foam material is tested. Thus, in this embodiment, the ILD of the layer will be the ILD of the foam material tested.

Layer 18 may be comprised of several foam materials. Thus, in the preferred embodiment illustrated in FIG. 2, layer 18 is comprised of front portion 34 and rear portion 36. Rear portion 36, when joined with the rear portion of upper layer 16, defines a U-shaped cavity.

Figure 2:
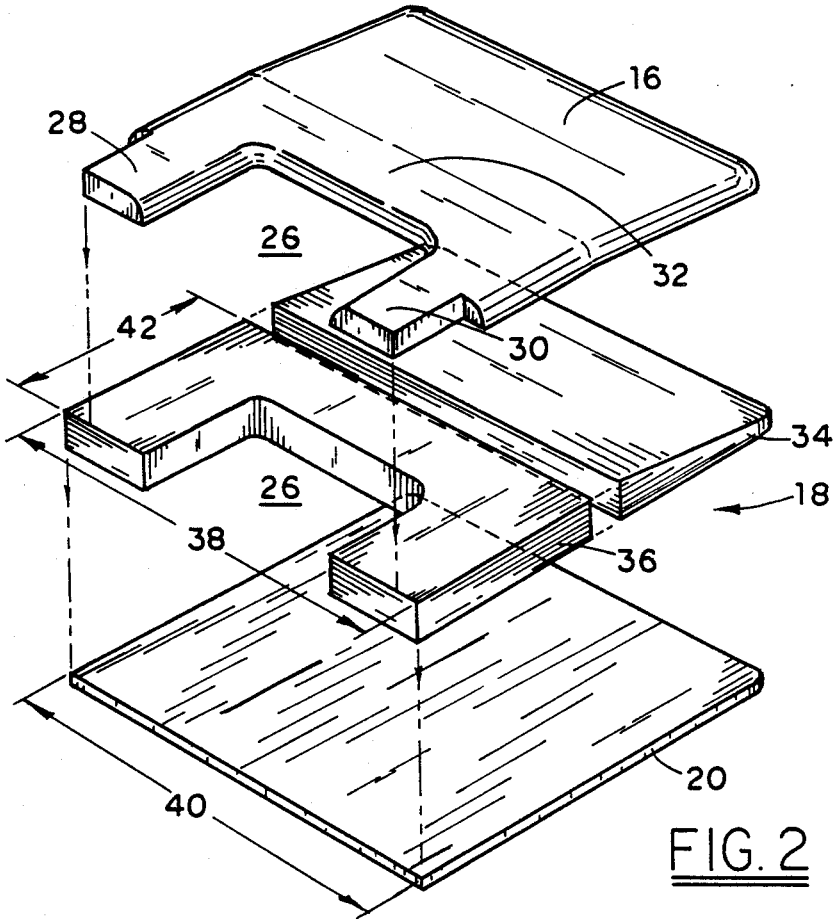
FIG. 2 is an exploded illustration of the embodiment of FIG. 1.

It is preferred, in the embodiment illustrated in FIG. 2, that the width 38 of rear portion of 36 be at least as great as the width 40 of lower layer 20 and preferably be substantially equal thereto.

Figures 3, 4, 5, 6:
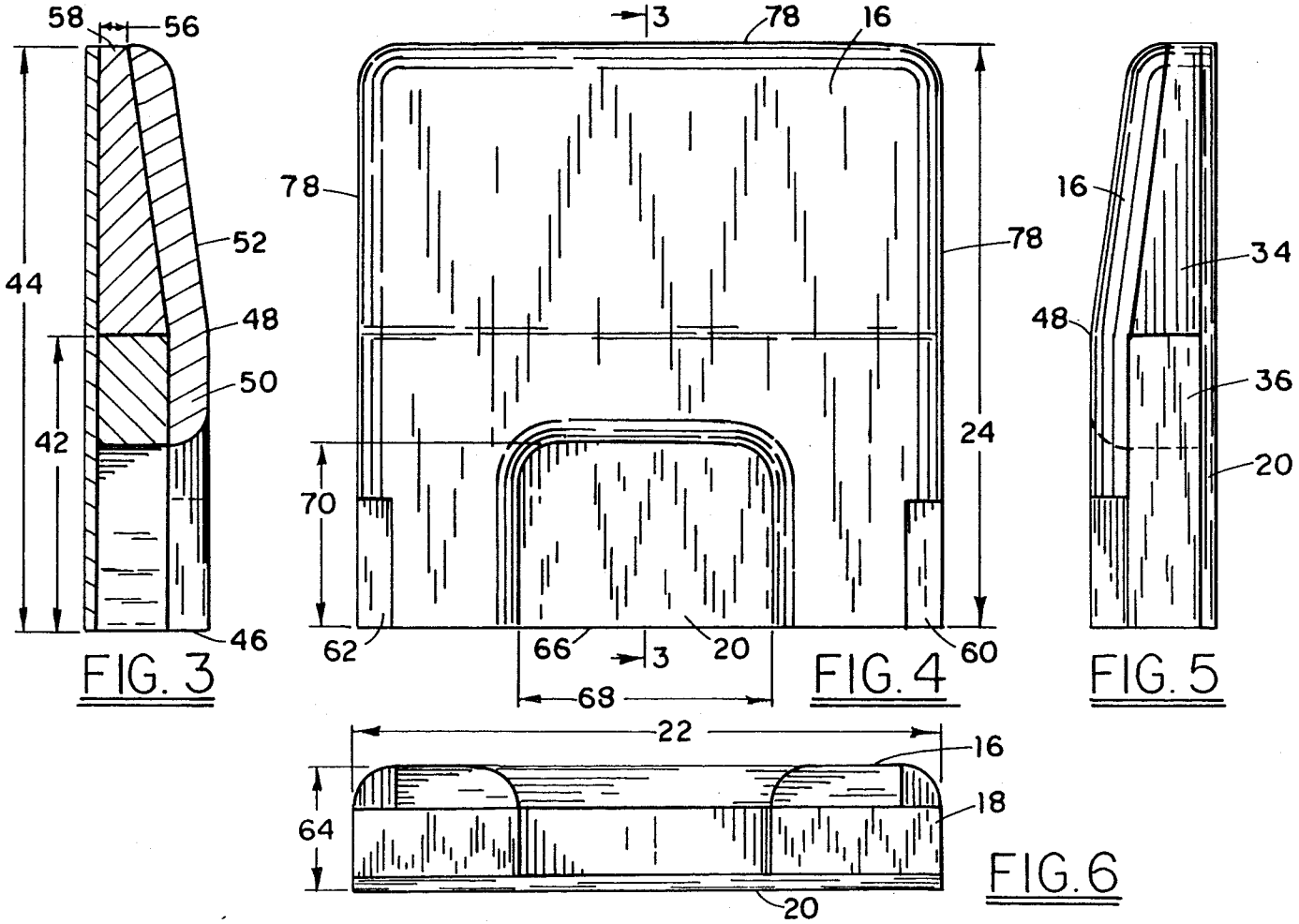
FIG. 3 is a sectional view, taken along lines 3—3, of FIG. 4.
FIG. 4 is a top (plan) view of the embodiment of FIG. 1.
FIG. 5 is a side view of the embodiment of FIG. 1.
FIG. 6 is a rear view of the embodiment of FIG. 1.

The length 42 of rear portion 36 of layer 18 is at least about 30 percent of the length 44 of bottom layer 20; see, e.g., FIG. 3. It is preferred that length 42 be at least about 50 percent of the length 44. However, length 42 must extend from the end 46 to end 48 of flat horizontal section 50 of layer 16.

Referring to FIG. 3, it will be seen that, in the preferred embodiment illustrated in this Figure, upper layer 16 overlaps tapered section 34 of intermediate layer 18, and the cushion 10 thus has a tapered section 52 and a relatively flat horizontal section 50. The point maximum height of cushion 10, in the embodiment shown, extends from end 48 (at which the tapered portion begins) to end 46. Rear portion 36 of intermediate layer 18 must be joined to the underside of layer 16 and must extend from end 46 to end 48. It is preferred, however, that rear portion 36 extend no further than end 48.

In the preferred embodiment of FIGS. 2 and 3, the distance between ends 46 and 48 is at least 50 percent of distance 44 and, preferably, is from about 50 to about 70 percent of the length 44. It is preferred that the lengths of each of layers 16, 18, and 20 be substantially equal.

It is preferred that top layer 16 be from about 0.75 to about 1.5 inches thick and, preferably, be about 0.9 to about 1.1 inches. Rear layer 36 of layer 18 generally is at least about 1.7 times as thick as top layer 16 and is at least about 3.4 times as thick as bottom layer 20; and rear layer 36 ranges from about 1.5 to about 2.5 inches.

Referring again to FIG. 3, front portion 34 of layer 18 ranges in thickness from a thickness substantially identical to that of rear layer 36 (at point where it abuts rear layer 36) to a thickness 56 at the front portion 58 of layer 18. Thickness 56 is from about 33 to about 50 percent of the thickness of rear portion 36 of layer 18, and it generally ranges from about 0.5 to about 1.0 inches.

Bottom layer 20 is preferably from about 0.25 to about 1.0 inch thick, and preferably is from about 0.4 to about 0.7 inches thick.

It is preferred that the identation load deflection (ILD) of rear portion 36 of layer 18 be from about 1.25 to about 2.5 times as great as the ILD of the front portion 34 of layer 18 and, preferably, be from about 1.5 to about 2.0 times as great as the ILD of said front portion. Rear portion 36 is the "stiffer part" of layer 18 referred to earlier in this specification; and, as indicated, its ILD is from about 100 to about 150 pounds. Front portion 34 is the less stiff part of layer 18, and its properties are within the ranges specified earlier in 5–6 the specification for the materials of layers 16 and 20.

In one embodiment, not shown, intermediate layer 18 is comprised of more than two parts. In this embodiment, the ratio of the ILD of rear portion 36 to the ratio of the ILD of front portion 34 is calculated by dividing the highest ILD in rear half of the layer 18 by the lowest ILD in the front half of layer 18.

It is preferred that the ILD of the stiffer part 36 of layer 18 be from about 1.25 to about 2.5 times as great as the ILD's of the material of bottom layer 20 and top layer 16; and it is more preferred that said ILD ratio be from about 1.5 to about 2.0. It is to be understood, however, that even though the ratios of the ILD's of part 36 to those of layers 20 and 16 are within the same range, they need not be identical.

Referring to FIG. 4, a top view of cushion 10 is shown. In the preferred embodiment illustrated in FIG. 4, downwardly extending indentations 60 and 62 extend from about the top of layer 16 at least as far as the top of layer 18; in once embodiment, not shown, the indentations extend some distance into the body of layer 18. The function of these indentations in this preferred embodiment is to provide swing clearance for flip down seat backs or chair backs on wheelchairs and similar devices.

Referring again to FIG. 4, an essential part of the invention is U-shaped aperture 26 of cushion 10. This aperture 26 allows a patient to sit on and be supported by cushion 10 without exerting pressure on his Ischial region.

U-shaped aperture 26 does not extend completely through cushion 10; it is essential that at least a portion of layer 20 provide a floor for said aperture. Referring to FIG. 6, the total height 64 of cushion 10 is shown. Aperture 26 will have a depth, extending from the top of layer 16 to a portion of layer 20, of from about 50 to about 95 percent of height 64 and, preferably, from about 80 to about 90 percent of height 64.

Aperture 26 commences at the end 66 of layers 16, 18, and 20 and extends therefrom in a forward direction. The width of aperture 26 is centered along the end 66 of layers 16, 18, and 20. In general, the width of aperture 26 is from about 25 to about 70 percent of the width of layers 16, 18 and 20 and, preferably, is from about 30 to 55 percent of the width of said layers. In general, aperture 26 will have a width of from about 4 to about 10 inches.

The length 70 of aperture 26 generally is from about 25 to about 95 percent of the length 42 of rear portion 36 of layer 18. It is preferred that length 70 be from about 40 to about 60 percent of the length 42 and be from about 4 to about 8 inches.

It is preferred that the aperture 26 be substantially U-shaped. It is also preferred that the upper edges of layer 16 and/or layer 18, which help to define aperture 26, be rounded or curved. In this embodiment, the radius of the edge rounding is preferably from about 0.5 to about 1.25 inches.

In another preferred embodiment, edges 78 of layer 16 and/or layer 18, are rounded or curved and preferably have a radius of from about 0.5 to about 1.25 inches.

Figure 7:
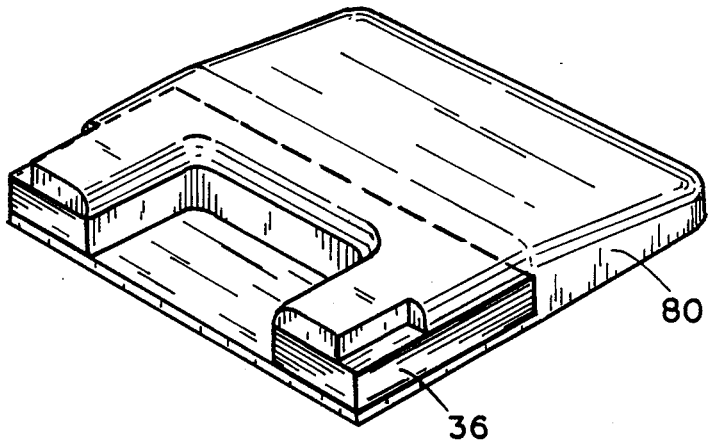
FIG. 7 is a perspective view of another embodiment of the invention.

Referring to FIG. 7, another preferred embodiment of the invention is illustrated. In this embodiment, layer 36 (which has the properties for the "stiffer part" of layer 18 described 6 earlier on this specification) is encased in a material whose properties are substantially identical to the less stiff part of cushion 10, 5 as described earlier in the specification. Layer 36, which has the dimensions and properties described heretofore, may be encase by the less stiff material by means well known to those skilled in the art to produce a molded cushion 10 with the desired properties. Thus, by way of illustration and not limitation, one may insert part 36 into a mold cavity and pour or inject material 80 into the mold to encapsulate part 36. Thereafter, material 80 may be cured. Suitable molding processes for effecting this end are well known to those skilled in the art and are described in pages 576 to 636 of said Brage Golding's "Polymers and Resins," supra.

Referring again to the embodiment of FIG. 1, layers 16, 20, and 18 are joined to each other to produce an integral cushion. These parts may be joined by means well known to those skilled in the art such as, e.g., by contact or other adhesives, sonic welding, and the like. It is preferred to join the parts by adhesives; any of the adhesives well known to those in the art may be used. See, e.g., pages 81–86 of Volume 1 of the McGraw-Hill Encyclopedia of Science and Technology (McGraw-Hill Book Company, New York, 1977), the disclosure of which is hereby incorporated by reference into this specification.

The following example is presented to illustrate the claimed invention but is not to be deemed limitative thereof. Unless otherwise specified, all parts are by weight and all temperature are in degrees centigrade.

EXAMPLE 1

Polyurethane foam was purchased in bun form from the Recticel Foam Corporation of Leroy, New York. Products numbered GP220125N and GC170070N were so obtained. These buns were than carved into four distinct segments.

The first segment, corresponding to layer 16, was cut to a width of 16 inches, a length of 16 inches, and a thickness of 1 inch; this segment was cut from the GC170070N foam. An aperture, corresponding to aperture 26, was cut in its rearward edge; the aperture, which was 7 inches wide and 5 inches long, was centered along the rearward edge of the first segment. Indentations, corresponding to indentations 60 and 62, where cut in the rearward right and left edges of the segment; the indentations were 1 inch wide and 3.5 inches long; and these indentations extended completely through the segment. The edges of aperture and the periphery of this segment were rounded to a radius of 0.75 inches.

The second segment, which corresponded to layer 20, was cut to 16"×16"×1.0" size; this segment was also cut from the GC170070N foam. The forward right and forward left corners of layer 20 were rounded to a radius of 0.75 inches (see FIG. 2).

The third segment, which corresponds to rear segment 36 of layer 18, was cut from GP220125N to a width of 16 inches, a length of 8 inches, and height of 1.75 inches. A U-shaped aperture was cut in the rearward edge 66 of this segment, and its depth extended completely through the segment. This aperture, which was 7 inches wide and 5 inches long, was centered along the rearward edge 66 of this third segment. The forward corners of the aperture were rounded to a radius of 0.75 inches (see FIG. 4); and they correspond to the rounded forward corners of the aperture in the first segment, which also had a radius of 0.75 inches.

The fourth segment, which corresponds to front section 34 of layer 18, was cut from GC170070N to a width of 16 inches, a length of 8 inches, and a depth which varied linearly from a height of 1.75 inches at its rearward edge to a height of 0.75 inches at its forward edge. The forward right and forward left edges of this segment were rounded to a radius of about 0.75 inches.

The apertures in segments one and three were aligned, and these segments were bonded to each other with a pressure-sensitive contact adhesive. Thereafter, the rearward edge of the fourth segment was aligned with the forward edge of segment three, and the fourth segment was then adhesively bonded to both segment three and segment one. Thereafter, segment two was adhesively bonded to the bottom of segments three and four.

A integral, multi-layer cushion with an effective gross spring rate of 200 pounds per inch was obtained.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

What is claimed is:

1. A substantially rectilinear, integral pressure relief cushion with a front edge, a back side, a right side, a left side, and a bottom side, wherein said cushion consists essentially of foam material and is comprised of at least four sections of foam material, and wherein:

(a) said cushion has an effective gross spring rate of from about 75 to about 300 pounds per inch;

(b) said cushion is comprised of a top layer, a middle layer, and a bottom layer, said middle layer having a front portion and a back portion and being comprised of a first section of foam material disposed in said back portion of said middle layer and a second section of foam material disposed in said front portion of said middle layer, wherein:

1. the force deflection rating for said first section of foam material is from about 100 to about 150 pounds,
2. the force deflection rating for said second section of foam material is from about 50 to about 90 pounds.
3. the force deflection rating of said first section of foam material is from about 1.25 to about 2.5 times as great as the force deflection rating for said second section of foam material; and (c) said cushion is comprised of an aperture extending from about 50 to about 95 percent of the height of said cushion from said top side of said cushion towards said bottom side of said cushion, wherein:

1. said aperture defines a substantially U-shaped cavity as viewed from said top side of said cushion.
2. the width of said aperture is centered along said back side of said cushion, and is from about 25 to about 70 percent of the width of said cushion.
3. said aperture extends from said back side towards said front edge, and
4. the length of said aperture is from about 25 to about 95 percent of the length of said first section.

2. The cushion as recited in claim 1, wherein said foam material has a density of from about 1.5 to about 5.0 pounds per cubic foot, a tensile strength of at least about 1.25 pounds per square inch, a tear resistance of at least about 1.5 pounds per square inch, and a compression set of less than about 8 percent.

3. The cushion as recited in claim 2, wherein said foam is polyurethane foam.

4. The cushion as recited in claim 3, wherein said cushion weighs from about 0.75 to about 2.0 pounds.

5. The cushion as recited in claim 4, wherein the width and length of said cushion are substantially equal.

6. The cushion as recited in claim 4, wherein said cushion has an effective gross spring of from about 150 to about 275 pounds per inch.

* * * * *